US006881069B2

(12) United States Patent
Chen

(10) Patent No.: US 6,881,069 B2
(45) Date of Patent: Apr. 19, 2005

(54) POWER ADAPTER WITH FREELY ROTATABLE DIRECT CURRENT PLUG CONNECTION

(75) Inventor: Chen-Chun Chen, Taoyuan (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 10/065,343

(22) Filed: Oct. 7, 2002

(65) Prior Publication Data

US 2004/0043665 A1 Mar. 4, 2004

(30) Foreign Application Priority Data

Aug. 27, 2002 (TW) ..... 91119341 A

(51) Int. Cl.[7] ..... H01R 39/00
(52) U.S. Cl. ..... 439/13; 362/226
(58) Field of Search ..... 439/23, 27, 20–22, 439/18, 503, 501, 29, 638, 502, 11–13; 362/225, 265; 320/138, 114

(56) References Cited

U.S. PATENT DOCUMENTS 3,937,543 A * 2/1976 Tomaro ..... 339/6
6,402,546 B1 * 6/2002 Groves et al. ..... 439/501
6,428,348 B1 * 8/2002 Bean ..... 439/501

* cited by examiner

*Primary Examiner*—Alex Gilman
(74) *Attorney, Agent, or Firm*—Jiang Chyun IP Office

(57) ABSTRACT

A power adapter having a freely rotatable plug connection comprises a main body, a DC wire, and an AC wire. The main body includes a casing that respectively encloses an adapter circuit board, a DC connector port and an AC connector port, the DC connector port and the AC connector port being respectively arranged on the adapter circuit board. A terminal of the DC wire electrically connects a DC plug that mates with the DC connector port according to a freely rotatable manner, and another terminal of the DC wire electrically connects an output plug to deliver a signal to an electrical device. A terminal of the AC wire electrically connects the AC connector port and another terminal of the AC wire electrically connects another plug.

22 Claims, 3 Drawing Sheets

POWER ADAPTER WITH FREELY ROTATABLE DIRECT CURRENT PLUG CONNECTION

CROSS REFERENCE TO RELATED APPLICATIONS

This application claims the priority benefit of Taiwan application serial no. 91119341, filed Aug. 27, 2002.

BACKGROUND OF INVENTION

1. Field of the Invention

The invention relates generally to a power adapter that converts an alternating current (AC) to a direct current (DC). More particularly, the invention provides a power adapter having a freely rotatable DC plug connection that can relieve mechanical stresses produced in the DC wire when it is wound.

2. Description of the Related Art

FIG. 1A is a perspective view showing the connection conventionally achieved between a direct current (DC) wire and a DC terminal of a power adapter. As shown, a traditional power adapter 100 comprises a main body 102, a DC wire 104, and an alternating current (AC) wire 108. The main body 102 further includes a DC terminal 102*a* and an AC terminal 102*b* that, respectively, electrically connect the DC wire 104 and the AC wire 108.

Within the traditional power adapter 100, the electrical and mechanical connection between the main body 102 and the DC wire 104 is usually achieved via welding, which therefore fixedly attaches the DC wire 104 to the main body 102. As a result, when the DC wire 104 is wound around the main body 102 for convenient arrangement, the definitive fixation between the DC wire 104 and the DC terminal 102*a* causes the generation of internal mechanical stresses at their corresponding connecting zone. To attenuate the effects caused by these mechanical stresses, a stress-buffer structure 106 may be provided at the connecting zone between the DC wire 104 and the DC terminal 102*a*.

FIG. 1B is a perspective view showing the traditional connection between the AC wire and the AC connector port within a power adapter. As shown, the casing 102 is further provided with an AC connector port 110 that is placed at the AC terminal 102*b*. The AC wire 108 directly engages by insertion in the AC connector port 110.

At some degree, the stress-buffer structure 106 may attenuate the mechanical stresses produced at the connecting zone between the DC wire 104 and the main body 102 during wire winding. However, this beneficial result is limited because the bending angle of the wound DC wire 104 is excessively high.

SUMMARY OF INVENTION

An aspect of the invention is therefore to provide a power adapter having a freely rotatable DC plug connection that can relieve the mechanical stresses produced when the DC wire is wound around the power adapter.

To accomplish the above and other objectives, a power adapter having a freely rotatable plug connection comprises a main body, a DC wire, and an AC wire. The main body includes a casing that respectively encloses an adapter circuit board, a DC connector port and an AC connector port, the DC connector port and the AC connector port being respectively arranged on the adapter circuit board. A terminal of the DC wire electrically connects a DC plug that mates with the DC connector port according to a freely rotatable manner, and another terminal of the DC wire electrically connects an output plug to deliver a signal to an electrical device. A terminal of the AC wire electrically connects the AC connector port and another terminal of the AC wire electrically connects another plug.

In accordance with the above and other objectives, the casing is provided with an opening at a location corresponding to that of the DC connector port. The DC plug further includes an electrical connecting part mating with the DC connector port, and an insulating part partially covering the electrical connecting part. A slot is defined on the insulating part of the DC connector port to engage by fitting with a rim of the opening of the casing while allowing a free rotation of the DC plug relative to the casing.

In accordance with the above and other objectives, the insulating part of the DC connector port is further provided with a stress-buffer structure that relieves wire winding-induced mechanical stresses.

In accordance with the above and other objectives, the casing of the main body is further formed in an approximately parallelepiped shape that is provided with at least a recessed cavity. The recessed cavity receives the DC plug and a portion of the wound DC wire.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

Figure 1A:
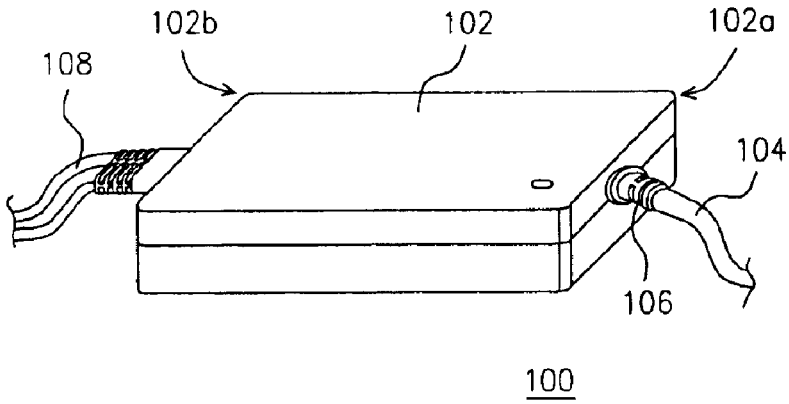
FIG. 1A (PRIOR ART)
FIG. 1A is a perspective view showing the connection structure conventionally achieved between a direct current (DC) wire and a DC terminal of a power adapter.
Figure 1B:
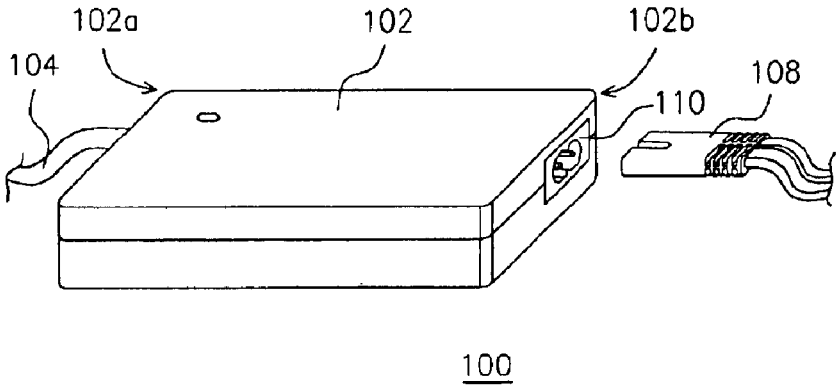
FIG. 1B (PRIOR ART)
FIG. 1B is a perspective view showing the connection structure conventionally achieved between an alternating current (AC) wire and an AC terminal of the power adapter.

The following detailed description of the embodiments and examples of the present invention with reference to the accompanying drawings is only illustrative and not limiting. Furthermore, wherever possible in the description, the same reference symbols will refer to similar elements and parts unless otherwise illustrated in the drawings.

Figure 2:
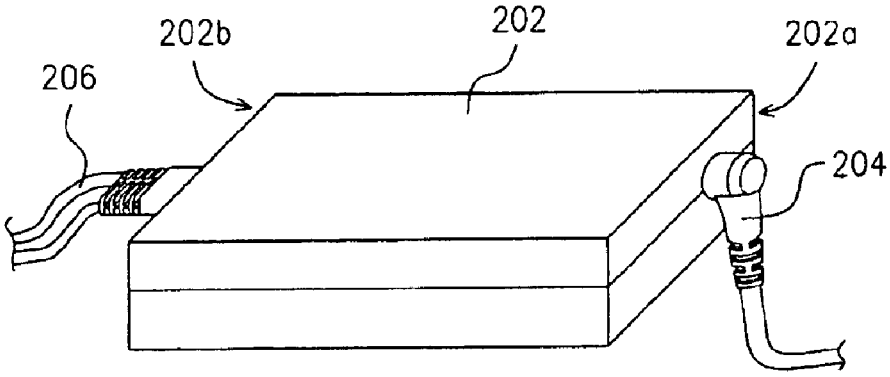
FIG. 2 is a general perspective view of the external connection structure of a power adapter according to an embodiment of the invention.

FIG. 2 is a general perspective view illustrating the external connection structure of a power adapter according to an embodiment of the invention. As shown, a power adapter 200 of the invention comprises a main body 202, a direct current (DC) wire 204 and an alternating current (AC) wire 206. The main body 202 includes a DC terminal 202*a* and an AC terminal 202*b* that, respectively, electrically connect the DC wire 204 and the AC wire 206. A major aspect of the invention is characterized in that the DC wire 204 connects the main body 202 according to a freely rotatable manner to relieve the mechanical stresses produced at the connecting zone between the DC wire 204 and the DC terminal 202*a* when the DC wire 204 is wound around the main body 202. The connection of the DC wire 204 to the DC terminal 202*a* is detailed hereafter.

Figure 3:
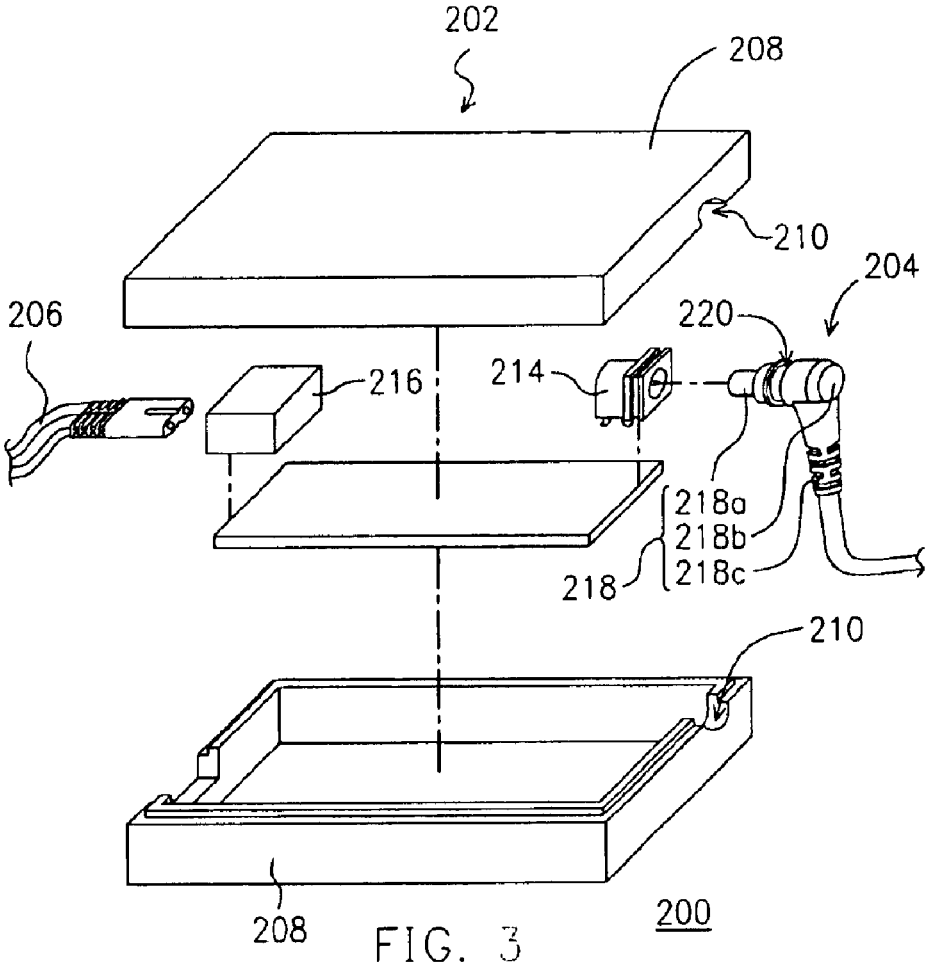
FIG. 3 is an exploded view schematically illustrating the external connection structure of a power adapter according to an embodiment of the invention.

FIG. 3 is an exploded view that schematically illustrates the external connection structure of a power adapter according to an embodiment of the invention. As shown, the main body 202 comprises a casing 208 that respectively encloses an adapter circuit board 212, a DC connector port 214 and an AC connector port 216. The DC connector port 214 and the AC connector port 216 are arranged on the adapter circuit board 212 to provide the necessary external connections of the power adapter. The casing 208 further includes an opening 210 corresponding to the location of the DC connector port 214.

A terminal of the DC wire 204 electrically connects a DC plug 218 that mates with the DC connector port 214 according to a freely rotatable manner by, for example, snap fitting. Another terminal of the DC wire 204 connects an output plug (not shown) to deliver a signal to an electrical device (not shown). Because the connection between the DC plug 218 and the DC connector port 214 is achieved via snap fitting and not welding as conventionally accomplished, the DC plug 218, once inserted in the DC connector port 214, is therefore capable of freely rotating relative to the latter. The DC connector port 214 is, for example, a jacket connector port.

The DC plug 218 comprises an electrical connecting part 218*a*, an insulating part 218*b* and a stress-buffer structure 218*c*. The electrical connecting part 218*a* mates with the DC connector port 214, and the insulating part 218*b* and the stress-buffer pars 218*c* partially cover the electrical connecting part 218*a*. A slot 220 is further externally defined on the insulating part 218*b*. When the DC plug 218 is inserted in the DC connector port 214, a rim of the opening 210 of the casing 208 engages by fitting with the slot 220 of the insulating part 218*a* to prevent a an unintentional separation of the DC plug 218 from the DC connector port 214 while allowing relative rotation there between. Furthermore, the association of the stress-buffer structure 218*c* with the snap fit connection of the DC plug 218 substantially relieves wire winding-induced mechanical stresses such as wire torsions and/or internal tensions at the connecting zone between the DC plug 218 and the casing 202.

With respect to the AC terminal 202*b* of the power adapter 200, a terminal of the AC wire 206 electrically connects to the AC connector port 216 and another terminal of the AC wire 206 electrically connects to, for example, a plug (not shown).

Figure 4:
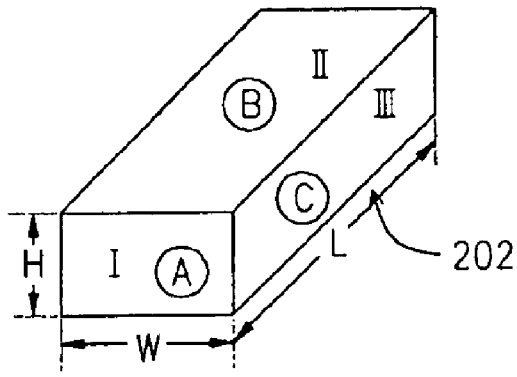
FIG. 4 is a schematic view schematically illustrating the placement of the DC plug within the power adapter according to an embodiment of the invention.

FIG. 4 is a schematic view illustrating the placement of the DC plug within the power adapter according to an embodiment of the invention. As shown, the reference symbols A, B, C represent different possible positions of the DC plug in the casing 202 shaped in a parallelepiped with a length L, a width W and a height H. The position A represents the conventional placement of the DC plug and is located on a planar surface I of the casing 202 defined by the directions (H, W). The position B is on a planar surface II defined by the directions (L, W). The position C is on a planar surface III defined by the directions (H, L).

The DC wire is conventionally wound around the casing 202 over the surfaces I, II. If the DC plug is placed at the position A, wire winding therefore causes a wire deformation that is close to the position A and, consequently, close to or on the stress-buffer structure. In contrast, if the DC plug is placed at either the locations B or C, the wire deformation is relatively farther from the DC plug and effectively occurs on the DC wire and not on the DC plug. As a result, the positions B and C are therefore the preferable positions of the DC plug to effectively prevent wire winding-induced mechanical stresses.

Figure 5A:
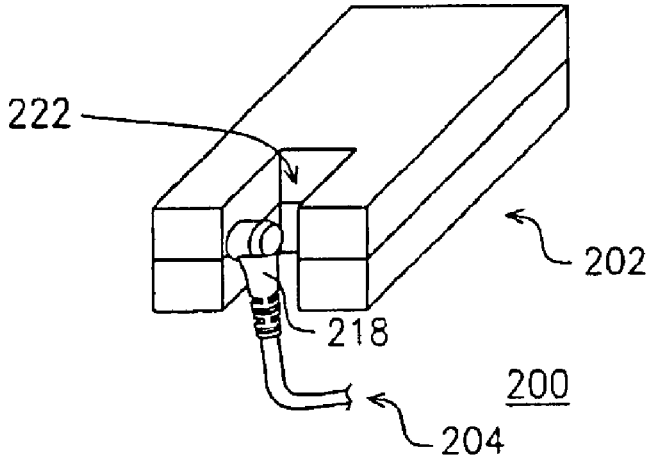
FIG. 5A and FIG. 5B are perspective views schematically illustrating the external connection structure of a power adapter according to a second embodiment of the invention.
Figure 5B:
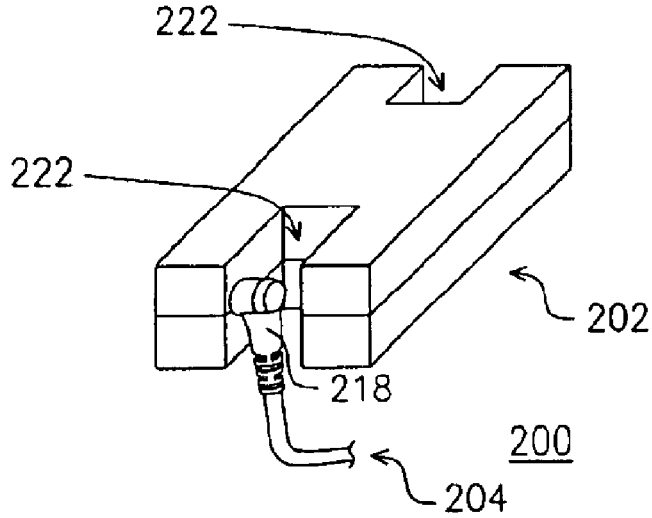

FIG. 5A and FIG. 5B are two perspective views showing the external connection structure of a power adapter according to a second embodiment of the invention. As shown in FIG. 5A, the casing 202 is in, for example, a parallelepiped shape provided with at least an approximately U-shaped recessed cavity 222. The recessed cavity 222 receives the DC plug 218 and, during wire winding, can further receive a portion of the wound DC wire 204, which increases the convenience of wire winding.

As shown in the variant example of FIG. 5B, two recessed cavities 222 may be oppositely formed through the casing 202 that, therefore, is formed in a general "H" shape. The DC plug 218 connects the power adapter in one of the recessed cavities 222 according to the above-described freely rotatable manner, and the DC wire 204 is wound around the casing 202 and partially received in the recessed cavities 222. The partial reception of the DC wire 204 in the recessed cavities 222 advantageously facilitates the winding operation.

As described above, the power adapter with a freely rotatable DC plug connection of the invention therefore includes at least the advantage of relieving mechanical stresses due to wire winding, which lengthens the service life of the DC plug. Moreover, the electrical and mechanical connection between the DC plug and the DC connector port is easily achieved via snap fitting.

It should be apparent to those skilled in the art that other structures that are obtained from various modifications and variations of different parts of the above-described structure of the invention would be possible without departing from the scope and spirit of the invention as illustrated herein. Therefore, the above description of embodiments and examples only illustrates specific ways of making and performing the invention that, consequently, should cover variations and modifications thereof, provided they fall within the inventive concepts as defined in the following claims.

What is claimed is:

1. A power adapter having a freely rotatable direct current (DC) plug connection, comprising:

a main body, including a casing that respectively encloses an adaptor circuit board, a DC connector port and an alternating current (AC) connector port, the DC connector port and the AC connector port being respectively arranged on the adapter circuit board;

a DC wire, having a first terminal electrically connected to a DC plug that mates with the DC connector port according to a freely rotatable manner, wherein the DC plug is detachably snapped to the DC connector port without an aid of using any mechanical tool while the DC plug is prevented from an unintentional separation from the DC connector; and an AC wire, having a second terminal electrically connected to the AC connector port.

2. The power adapter of claim 1, wherein the casing is formed in an approximately parallelepiped shape.

3. The power adapter of claim 1, wherein a third terminal of the DC wire further connects an output plug.

4. The power adapter of claim 1, wherein a fourth terminal of the AC wire connects a plug.

5. The power adapter of claim 1, wherein the casing is formed in an approximately parallelepiped shape and further includes at least a recessed cavity.

6. The power adapter of claim 5, wherein the DC plug freely and rotatably connects the casing within the recessed cavity.

7. The power adapter of claim 1, wherein the casing further includes an opening at a location corresponding to that of the DC connector port on the adapter circuit board.

8. The power adapter of claim 7, wherein the DC plug further comprises:

an electrical connecting part, mating with the DC connector port; and an insulating part, partially covering the electrical connecting part, the insulating part being further provided with a slot that engages by fitting with a rim of the opening of the casing in a man or to allow a free rotation of the DC plug relative to the casing while ensuring the electrical and mechanical connection there between.

9. The power adapter of claim 8, wherein the insulating part further includes a stress-buffer structure.

10. A freely rotatable electrical connection structure of an electrical device, comprising;

an electrical device, having a casing in which is arranged a direct current (DC) connector port and through which is defined an opening; and an electrical plug, including an electrical connecting part and an insulating part, the electrical connecting part rotatably mating with the DC connector port, and the insulating part further including a slot that engages by fitting with a rim of the opening of the casing in order to secure the connection between the electrical plug and the DC connector port while allowing a free rotation there between;

wherein the DC plug is detachably snapped to the DC connector port without an aid of using any mechanical tool while the DC plug is prevented from an unintentional separation from the connector.

11. The connection structure of claim 10, wherein the insulating part further includes a stress-buffet structure.

12. A power adapter having a freely rotatable direct current (DC) plug connection, comprising:

a main body, including a casing that respectively encloses an adapter circuit board, a DC connector port and an alternating current (AC) connector port, the DC connector port and the AC connector port being respectively arranged on the adapter circuit board;

a DC wire, having a first terminal electrically connected to a DC plug that mates with the DC connector port according to a freely rotatable manner, wherein the DC plug and the DC connector port are separate, and when the DC plug is detachably snapped to the DC connector port, a rim of an opening of the casing is engaged by fitting with a slot of the DC plug to prevent an unintentional separation of the DC plug from the DC connector port while allowing a relative rotation between the DC plug and the DC connector port and a detachment of the DC plug from the DC connector port without an aid of using any mechanical tool; and an AC wire, having a second terminal electrically connected to the AC connector port.

13. The power adaptor of claim 12, wherein the casing or includes an opening at a location corresponding to that of the DC connector port on the adapter circuit board.

14. The power adapter of claim 12, wherein the DC plug further comprises:

an electrical connecting part, mating with site DC connector part; and an insulating part, partially covering the electrical connecting part, the insulating part being further provided with a slot that engages by fitting with a rim of the opening of the casing in a manner to allow a free rotation of the DC plug relative to the casing while ensuring the electrical and mechanical connection there between.

15. The power adapter of claim 12, wherein the insulating part further includes a stress-buffer structure.

16. The power adapter of claim 12, wherein the casing is formed in an approximately parallelepiped shape.

17. The power adapter of claim 12, wherein a third terminal of the DC wire further connects an output plug.

18. The power adapter of claim 12, wherein a fourth terminal of the AC wire connects a plug.

19. The power adapter of claim 12, wherein the casing is formed in an approximately parallelepiped shape and further includes at least a recessed cavity.

20. The power adapter of claim 19, wherein the DC plug freely and rotatably connects the casing within the recessed cavity.

21. A freely rotatable electrical connection structure of an electrical device, comprising:

an electrical device, having a casing in which is arranged a direct current (DC) connector port and through which is defined an opening; and an electrical plug, including an electrical connecting part and an insulating part, the electrical connecting part rotatably mating with the DC connector port, and the insulating part further including a slot that engages by fitting with a rim of the opening of the casing in order to secure the connection between the electrical plug and the DC connector port while allowing a free rotation there between;

wherein the electrical plug and the DC connector port are separate, and when the electrical plug is detachably snapped to the DC connector port, the rim of an opening of the casing is engaged by fitting with the slot of the electrical plug to prevent an unintentional separation of the electrical plug from the DC connector port while allowing a relative rotation between the electrical plug and the DC connector port and a detachment of the DC plug from the DC connector port without an aid of using any mechanical tool.

22. The connection structure of claim 21, wherein the insulating part further includes a stress-buffet structure.

* * * * *